US006155916A

United States Patent [19]

Rudolf et al.

[11] Patent Number: 6,155,916

[45] Date of Patent: Dec. 5, 2000

[54] POWER-DRIVEN HAND TOOL

[75] Inventors: Boris Rudolf, Stuttgart; Heinrich Henssler, Schwäbisch Gmünd, both of Germany

[73] Assignee: C. & E. Fein GmbH & Co.

[21] Appl. No.: 09/170,544

[22] Filed: Oct. 13, 1998

[30] Foreign Application Priority Data

Oct. 14, 1997 [DE] Germany ..... 197 45 306

[51] Int. Cl.[7] ..... B24B 23/02

[52] U.S. Cl. ..... 451/344; 451/358; 451/359

[58] Field of Search ..... 451/342, 343, 451/344, 358, 359

[56] References Cited

U.S. PATENT DOCUMENTS

| | | | |
|---|---|---|---|
| 4,060,940 | 12/1977 | DeWitte | 51/170 PT |
| 4,382,334 | 5/1983 | Reynolds . | |
| 5,170,532 | 12/1992 | Holmin et al. | 16/111 R |
| 5,172,522 | 12/1992 | Jares . | |
| 5,681,214 | 10/1997 | Kleider et al. | 451/358 |

FOREIGN PATENT DOCUMENTS

| | | |
|---|---|---|
| 142650 | 9/1984 | European Pat. Off. . |
| 0493033 A1 | 7/1992 | European Pat. Off. . |
| 2559132 | 12/1975 | Germany . |
| 2816485 A1 | 10/1979 | Germany . |
| 3826212 | 8/1988 | Germany . |
| 3921752 | 7/1989 | Germany . |
| 4422247 A 1 | 6/1994 | Germany . |
| 2124536 | 5/1985 | United Kingdom . |

*Primary Examiner*—Eileen P. Morgan
*Attorney, Agent, or Firm*—Cummings & Lockwood

[57] ABSTRACT

A power-driven hand tool is disclosed, having a housing in which a drive for a tool is received, having at least a first handle which is fastened to a support that is attached at a first end to the housing and with a second end projects laterally out from the housing. The support has at its second end at least a first receptacle for attachment of the first handle in a first position such that the first handle projects with one free end in the direction of the housing. Preferably a second receptacle is also provided, for attaching of the first handle in a second position angled with respect to the first position. In addition, a second handle, which is preferably is configured as a switch handle and is displaceable into various positions about its longitudinal axis, can be arranged preferably at the opposite end of the housing. A particularly ergonomic posture and fatigue-free operation are made possible.

12 Claims, 5 Drawing Sheets

POWER-DRIVEN HAND TOOL

BACKGROUND OF THE INVENTION

The present invention relates to a power-driven hand tool having a housing in which a drive for a tool is received, having at least a first handle which is fastened to a support that is attached at a first end to the housing and with a second end stands laterally out from the housing.

A hand tool of this kind is known from DE 38 26 212 A1.

The known hand tool is a hammer drill with a fixed stock handle mounted beneath the housing, and an additional stock handle (chiseling handle) which is mounted only when chiseling. The chiseling handle is attached to the housing on a cross brace provided perpendicular to the stock handle, and extends parallel to the stock handle but in the opposite direction, i.e. upward. In addition, the chiseling handle can be pivoted a certain amount in order to allow the hand tool to be held better.

The known hand tool may indeed allow improved gripping of the hand tool as a hammer drill, but the additional installation and removal of the second handle has proven cumbersome and in some cases disruptive. In addition, even with an additional handle of this kind, an optimal and in particular ergonomic posture for the user of the hand tool is still not possible.

In the case of a power drill, it is moreover known in principle from EP 0 142 650 A2 to provide at the end of the drill, in addition to a pistol-shaped handle, an additional handle which is attached to the spindle neck of the power drill below the drive train housing by means of a band clamp. The additional handle is joined at both of its ends to a yoke which transitions into the band clamp for attachment to the spindle neck of the drill.

Although an improved and more economical posture is made possible in this fashion, greater damping is often desirable, particularly when used for hammer-drilling.

A variety of yoke handle arrangements, some of them adjustable, for use with hand tools has also been disclosed (cf. DE 25 59 132 C2, DE 39 21 752 A1, U.S. Pat. No. 4,060,940). The use of such yoke handles results in some cases in an enlargement, and in cumbersome handling, of the hand tool. Moreover, as before, sufficient damping is not guaranteed with respect to vibrations which occur while working.

A further problem with hand tools of this kind occurs in particular when working with heavy right-angle grinders, which as a rule must be held using two handles, specifically a first handle on the front end of the housing in the vicinity of the grinding disk, and a second handle at the rear end of the housing which is usually combined with a switch. In the case of a right-angle grinder of this kind as known, for example, from U.S. Pat. No. 4,060,940, the front handle facing the grinding disk is yoke-shaped, and extends above the housing to an attachment point on the safety shroud.

An arrangement of this kind can be optimized either for cutting (working in the direction of the cutting disk), or for roughing (working in planar fashion with the surface of the roughing disk). An optimal posture for both roughing and cutting, with simultaneous damping of the handle, is not, however, possible in this case.

SUMMARY OF THE INVENTION

It is therefore an object of the invention to provide a power-driven hand tool allowing improved handling particularly when embodied as a right-angle grinder, in order to allow operation with as little fatigue as possible. It is a further object of the invention to achieve improved damping for impacts, vibrations, oscillating motions, load reactions, and the like which proceed from the tool, so that even when working under difficult conditions with heavy equipment, the user will experience as few fatigue phenomena as possible.

These and other objects are achieved according to the invention, in the case of a hand tool of the type cited initially, in that the support has at its second end at least a first receptacle for attachment of the first handle in a first position such that the first handle projects with one free end in the direction of the housing.

The object of the invention is completely achieved in this fashion.

Specifically, according to the invention, because the handle projects from a support with one free end in the direction of the housing, the handle is located closer to the center of gravity of the hand tool, so that the hand tool can be held much more easily because lever arms are shorter. Moreover, because the handle is not received at one end on a yoke or the like, but rather stands out freely from the support, an improved damping effect is achieved, so that vibrations, impacts, etc. which occur while working are perceived to a much reduced degree by the user of the hand tool.

In a preferred development of the invention, the support has at least a second receptacle for attaching the first handle in a second position that is angled with respect to the first position.

This makes possible optimal adaptation of the position of the handle to various methods of working with the hand tool.

In a preferred development of this configuration, the hand tool is embodied as a right-angle grinder having an elongated housing that has at its tool end a drive train housing having a drive spindle for a disk-shaped tool arranged at an angle to the longitudinal axis of the housing, the first and the second receptacle of the support being arranged such that the first handle is positioned in the first position for roughing, and in the second position for cutting.

It is thereby possible to achieve, with one handle that can be fastened selectably in the first or the second position on the support, an improved posture for the user for both cutting and roughing, so as thus to minimize fatigue while working in both operating modes.

In an additional development of this embodiment, the second receptacle is arranged such that the first handle, attached in the second position, extends in such a way that a plane passing through the center of gravity of the hand tool extends approximately through the center of the first handle.

This allows a fatigue-free posture when the hand tool is being used for abrasive cutting, above the safety shroud of the right-angle grinder. Tilting moments that previously occurred in the case of conventional right-angle grinders with handles are thus largely eliminated. At the same time, the first handle which stands out from the support with one free end guarantees good damping.

In a development of this embodiment, the first receptacle is arranged so that in the first position, the first handle extends on the side of the drive train housing facing away from the tool in the vicinity of the rotation axis of the drive spindle.

This results in a hand tool posture in roughing operation which is as fatigue-free as possible, since the first handle is located above the tool, configured as a roughing disk, in the vicinity of the center of gravity, which extends approximately through the rotation axis of the working spindle.

A combination of these two features can thus yield an optimized, fatigue-free posture for both cutting and roughing. At the same time, the tool can be guided during both cutting and roughing.

In an additional development of the invention, a second handle is arranged on the end of the housing facing away from the tool, substantially in the longitudinal direction of the housing, and is displaceable about its longitudinal axis at least into two angular positions.

It is thus possible to achieve improved guidance and posture especially when the hand tool is embodied as a right-angle grinder, since the right-angle grinder can be held with the second hand at the end, while the handle can at the same time be combined with the switch for switching the right-angle grinder on and off. The second handle can be comfortably grasped from above for both the cutting and the roughing operation, since it can be displaced into the desired position about its longitudinal axis depending on the operating mode. A displacement capability of a total of 2×90° is preferred, to allow abrasive cutting from both the right and left, as well as rough grinding.

In an advantageous development of the invention, the support can be locked with its first end on the housing in various angular positions.

This makes it possible to adapt the first handle optimally to the geometrical circumstances depending on the tool being used and the manner of operation of the hand tool, allowing the user to work with as little fatigue as possible, and also to work in poorly accessible areas.

In an advantageous development of this configuration, snap-lock elements which coact with one another are provided on the housing and at the first end of the support for positive fastening of the support in various angular positions.

This allows rapid and easy displacement of the first handle into the desired position; a spring, for example, can be provided to secure the support in the snap-locked position.

In an additional development of this embodiment, a stop is provided to limit the angular position of the support.

In this fashion, unsuitable positions of the first handle can be excluded, and possible injuries resulting from excessive displacement, for example toward the tool or toward a safety shroud in the case of the embodiment as a right-angle grinder, can be prevented.

As already mentioned previously, the fact that the end of the first handle stands out freely yields an improved damping effect.

In addition, the support can be specifically configured as a damping element for vibration damping.

For this purpose, it is possible to configure the support as, for example, a composite rubber-metal part, a plastic part with damping inserts, or the like.

According to a further embodiment of the invention, the support comprises a surface configured as a safety shield, for protection against contact with the tool.

In particular in the case of a utilization as a right-angle grinder, this ensures additional protection from flying sparks, regardless of the utilization or position of the relevant safety shroud.

According to a further embodiment of the invention, attachment points for the support are provided on two sides of the housing located opposite one another.

The first handle can thus be optimally positioned for both right-handed and left-handed persons.

According to a further embodiment of the invention, the hand tool is configured as a power drill having a second pistol-shaped handle on the end of the housing facing away from the tool, and the first handle, in the first position, is inclined obliquely to the rear toward the second pistol-shaped handle, at an acute angle with respect to a plane extending perpendicular to the rotation axis of a drill chuck.

An ergonomically optimized posture when working with the power drill is achieved in this fashion.

It is understood that the features mentioned above and those yet to be explained below can be used not only in the respective combinations indicated, but also in other combinations or in isolation, without leaving the context of the present invention.

SHORT DESCRIPTION OF THE DRAWINGS

Further features and advantages of the invention are evident from the description below of preferred exemplifying embodiments with reference to the drawings, in which.

DETAILED DESCRIPTION OF THE PREFERRED EMBODIMENTS

Figure 1:
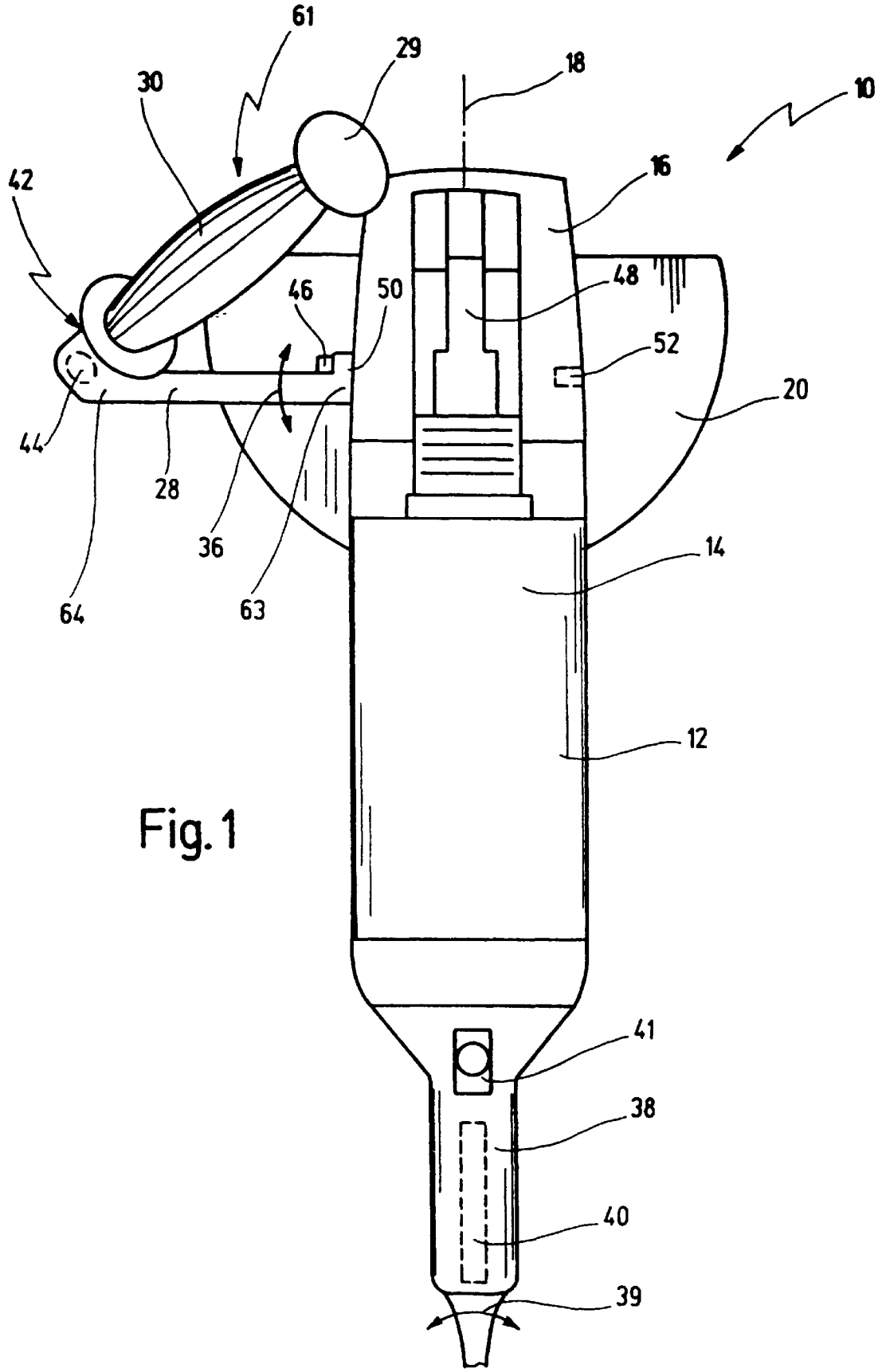
FIG. 1 shows a first embodiment of the invention using the example of a right-angle grinder, the first handle being located in a position suitable for roughing.

In FIG. 1, a hand tool according to the invention is designated overall with the number 10.

Hand tool 10 is an embodiment as a two-handed right-angle grinder, having a first handle 30 on the front end of housing 12, and a second handle 38 at the rear end of the housing, configured as a switch handle.

The right-angle grinder is equipped in known fashion with a quick-release clamping lever 48 for clamping in a grinding disk, and, also in known fashion, has a safety shroud 20 for the grinding disk, which if applicable can be arranged in angularly displaceable fashion.

Received in housing 12 is a drive 14 (not shown further) in the form of an electric motor, the rotary motion of which is converted via a right-angle drive train in drive train housing 16 at the front end of housing 12 into a drive motion for a drive spindle with which the tool in the form of a roughing or cutting disk is driven.

First handle 30 is fastened to a support 28, configured approximately as a rod, which stands out to the side approximately at right angles from drive train housing 16, and is fastened with a first end 63 into a receptacle 50 in the form of a threaded hole, with the aid of a fastener such as, for example, a screw 46. Support 28 has at its second, outer end 64 a first receptacle 42 for receiving first handle 30, and a second receptacle 44, indicated only schematically, for receiving first handle 30 in a different position.

In first position 61 of first handle 30 as shown in FIG. 1, the latter is threaded into first receptacle 42 which is configured as a blind threaded hole, and with its outer, free end 29 projects approximately obliquely forward and toward longitudinal axis 18 of housing 12. In this first position 61, first handle 30 encloses an angle of approximately 30 to 70° with support 28.

In the position shown in FIG. 1, the right-angle grinder is used for roughing, a workpiece being processed in planar fashion with the grinding disk. In this, the operator holds hand tool 10 with the left hand on first handle 30 and the right hand on second handle 38.

In order to allow the best possible guidance and fatigue-free operation, support 28 and first receptacle 42 are arranged so that first handle 30 extends toward longitudinal axis 18 of housing 12, and is thus located above the center of gravity of the tool to the greatest extent possible. In order to guarantee an optimum position, support 28 is fastened to receptacle 50 of drive train housing 16 in angularly displaceable fashion, as indicated by double arrow 36.

Second handle 38 at the end of the right-angle grinder located opposite safety shroud 20 has a button 41 on its upper side and a switch 40 (merely indicated with dashed lines) on its underside. For safety reasons, switch 40 can only be actuated if button 41 is pushed down.

Second handle 38 is displaceable about its longitudinal axis, which runs approximately in the direction of longitudinal axis 18 of housing 12, into three different angular positions which are each offset 90° from one another, as indicated by double arrow 39. In the position for roughing that is shown, the second handle is located in a position such that button 41 is at the top and switch 40 is on the lower side, so that when working, button 41 can be pressed down with the thumb and button 40 can then be actuated by contracting the remaining fingers on the underside of handle 38.

Because first handle 30 is fastened to second end 64 of support 28 which stands out laterally from drive train housing 16, and the handle is threaded into first receptacle 42 at second end 64 of support 28 only with one end while the other end of handle 30 is configured as a free end 29, first handle 30 contributes substantially toward the damping of vibrations, load cycle movements, oscillations, and the like which are transferred from the tool to the handle while working. In addition, the particular arrangement of first handle 30 and second handle 38 results in an ergonomically particularly favorable posture which can additionally be optimized by angular displacement of support 28. Since first handle 30 is located in the vicinity of drive train housing 16, and thus above and close to the center of gravity of the tool, relatively low lever forces occur, thus allowing fatigue-free operation.

In the position shown, first handle 30 is mounted for right-handers, who normally guide the tool with their right hand on second handle 38 and their left hand on first handle 30.

For left-handed operation, a further receptacle 52 for attaching support 28 is provided on the opposite side of right-angle head 16. If support 28 were threaded onto second receptacle 52, free end 29 of first handle 30 would naturally point once again toward drive train housing 16.

Figure 2:
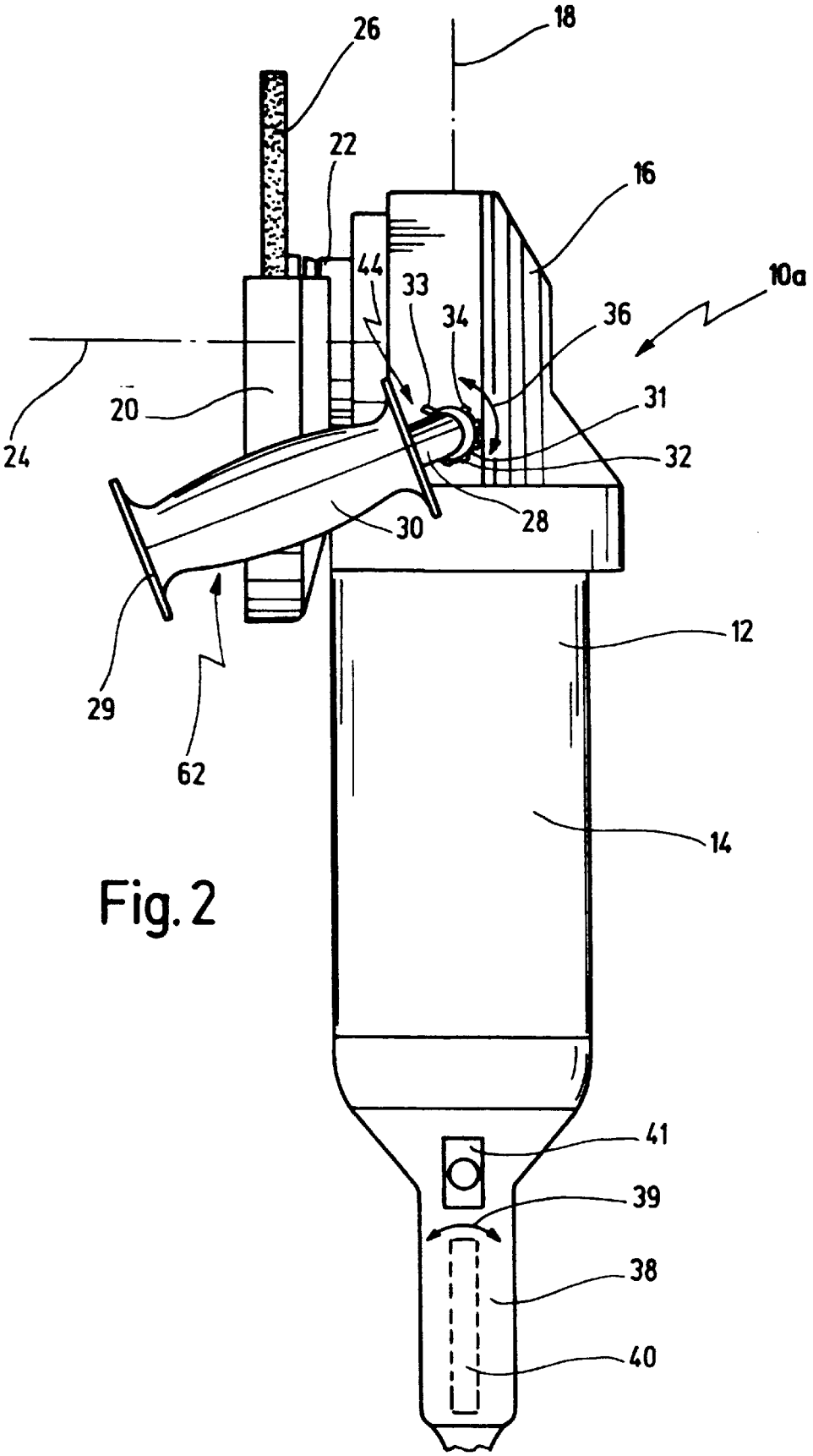
FIG. 2 shows a view of an embodiment slightly modified with respect to the embodiment shown in FIG. 1, in a position rotated 90°, the first handle now being located in a second position suitable for cutting.

FIG. 2 shows a hand tool 10*a*, once again configured as a right-angle grinder, from the side in a position rotated 90° as compared with the representation of FIG. 1. The right-angle grinder is configured largely identically to the right-angle grinder described previously with reference to FIG. 1, for which reason corresponding reference numbers are used for corresponding parts. In addition, as shown in FIG. 2, a tool 26 in the form of a cutting disk is clamped onto drive spindle 22. In addition, support 28 is not connected in threaded fashion to right-angle head 16, but rather is fastened in snap-lock fashion in various angular positions by means of snap-lock elements 31, 32, as indicated by double arrow 36. A spring element (not shown) is also provided for fastening in a snap-locked position.

The right-angle grinder is shown in a position suitable for cutting, first handle 30 now being threaded into second receptacle 44 of support 28 and thus being located in a second position 62 which is angled with respect to first position 61 shown in FIG. 1.

First handle 30 is located in a plane extending approximately parallel to rotation axis 24 of drive spindle 22, and if desired, as shown by double arrow 36, can also be aligned with its longitudinal axis parallel to rotation axis 24 of drive spindle 22.

Stops 33, 34 prevent first handle 30 from being displaced into an unsuitable angular position in which a risk to the user might occur.

Second handle 38 has been rotated counterclockwise 90° with respect to the position shown in FIG. 1, so that button 41 is located once again on the upper side of handle 38, and switch 40 on the underside of handle 38.

In the position of right-angle grinder that is shown and is suitable for cutting, first handle 30 extends in such a way that a plane passing through the center of gravity of hand tool 10*a* extends approximately through the center of first handle 30.

This makes it possible hold hand tool 10*a* in fatigue-free fashion by means of first handle 30, since hand tool 10*a* simply hangs vertically downward with no need to exert a tilting moment on handle 30.

In order to ensure an equally optimal position for the right-angle grinder when cutting and when rough grinding, all that is therefore necessary is to thread first handle 30 either into first receptacle 42 or into second receptacle 44 of support 28, and optionally adjust it angularly into a suitable position with the aid of snap-lock elements 31, 32. In addition, second handle 38 is rotated about its longitudinal axis into the appropriate position.

It is understood that instead of the displacement capability by means of snap-lock elements, other displacement capabilities can also be provided, and that the support can also be fastened onto the housing without the assistance of a tool, for example by means of a bayonet fastener in combination with a spring for pulling out and turning.

Several modifications of the right-angle grinder explained previously with reference to FIGS. 1 and 2 are shown in simplified perspective fashion in FIGS. 3 through 6, and designated overall with the numbers 10*b*, 10*c*, 10*d*, and 10*e*. Once again, identical reference numbers are used for corresponding parts.

Figure 3:
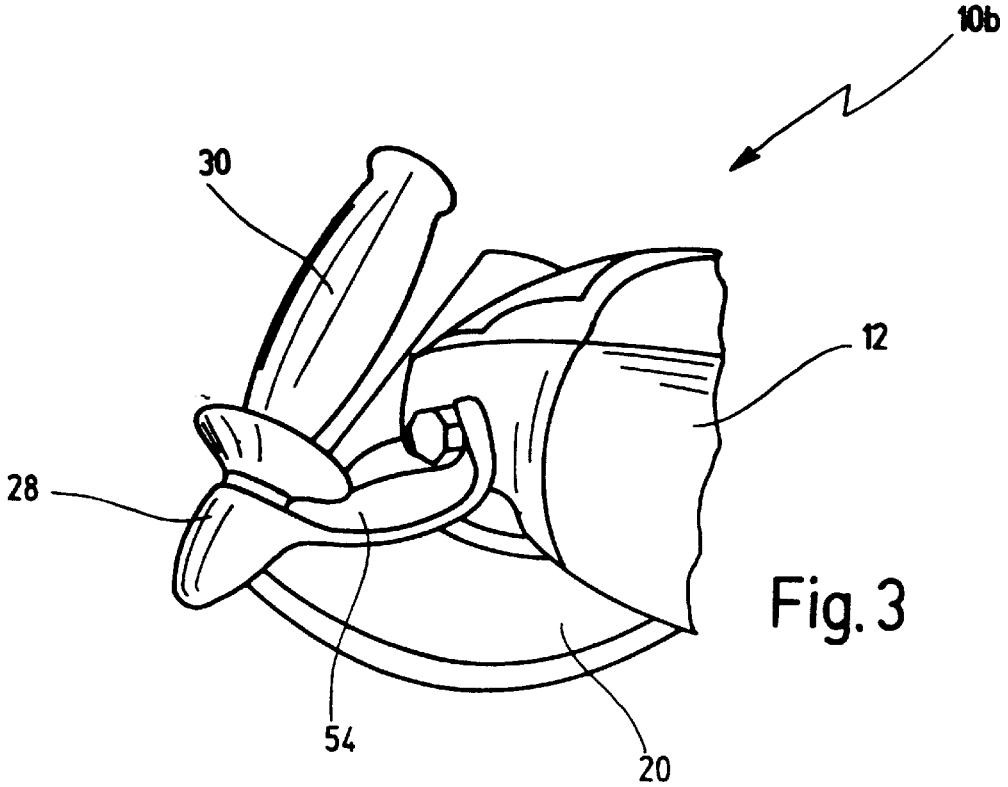
FIG. 3 shows a perspective view of a further embodiment of the hand tool according to the invention as a right-angle grinder, in the region of the drive train housing, the support for receiving the first handle additionally comprising a surface, configured as a safety shield, to protect against flying sparks.
Figure 4:
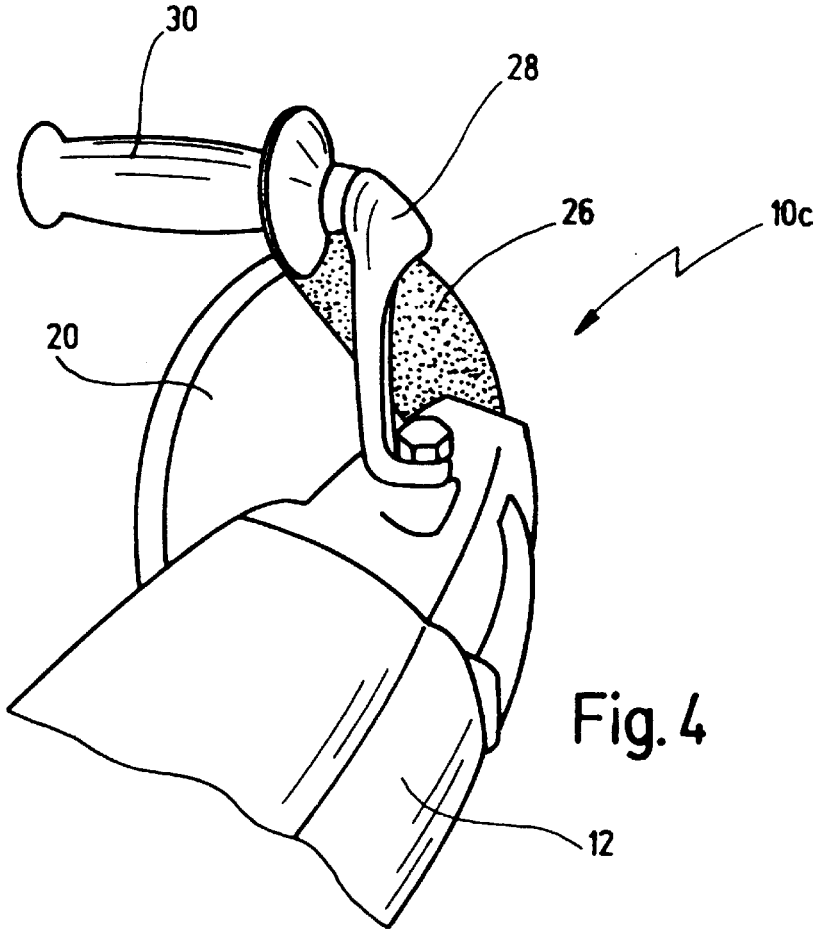
FIG. 4 shows a further modification of the invention in a perspective view, once again as a right-angle grinder, in a position suitable for cutting.

In FIG. 3, support 28 is additionally equipped with a widened surface in the form of a safety shield 54, so as thereby to ensure improved protection against contact with the grinding tool for a user's hand which is grasping hand tool 10*b* at first handle 30.

FIG. 4 once again shows a hand tool 10*c* configured as a right-angle grinder, but now in a position suitable for cutting, first handle 30, as is evident, extending approximately parallel. to the rotation axis of grinding tool 26. Support 28 corresponds to the embodiment explained previously with reference to FIGS. 1 and 2, without a safety shield.

Figure 5:
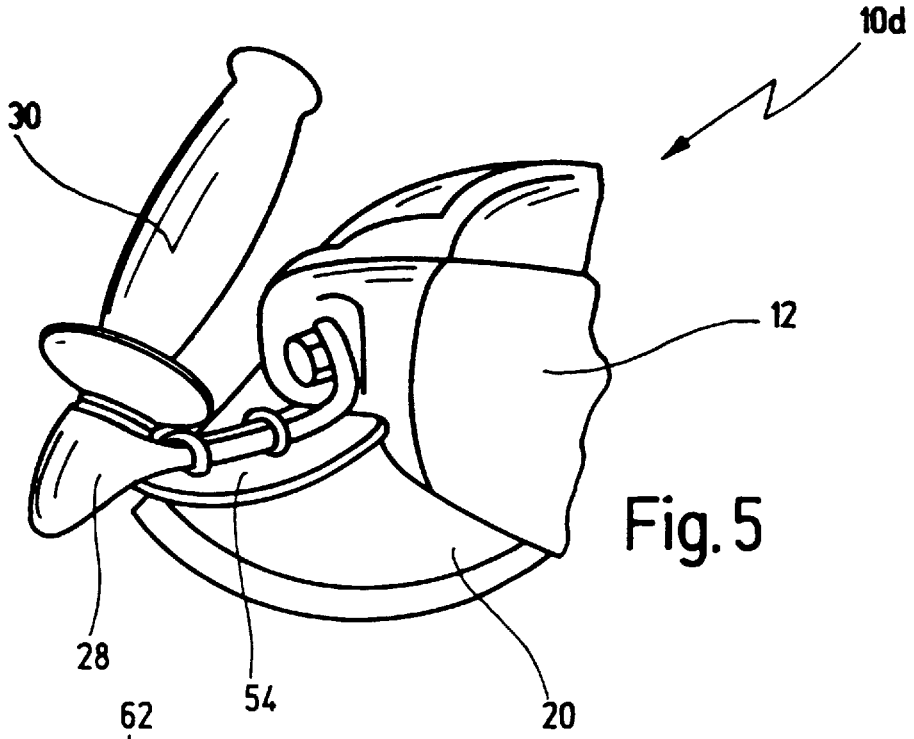
FIG. 5 shows a further modification of the embodiment shown in FIG. 3 in a perspective representation, once again in a position suitable for roughing, an additional safety shield being attached to the support.
Figure 6:
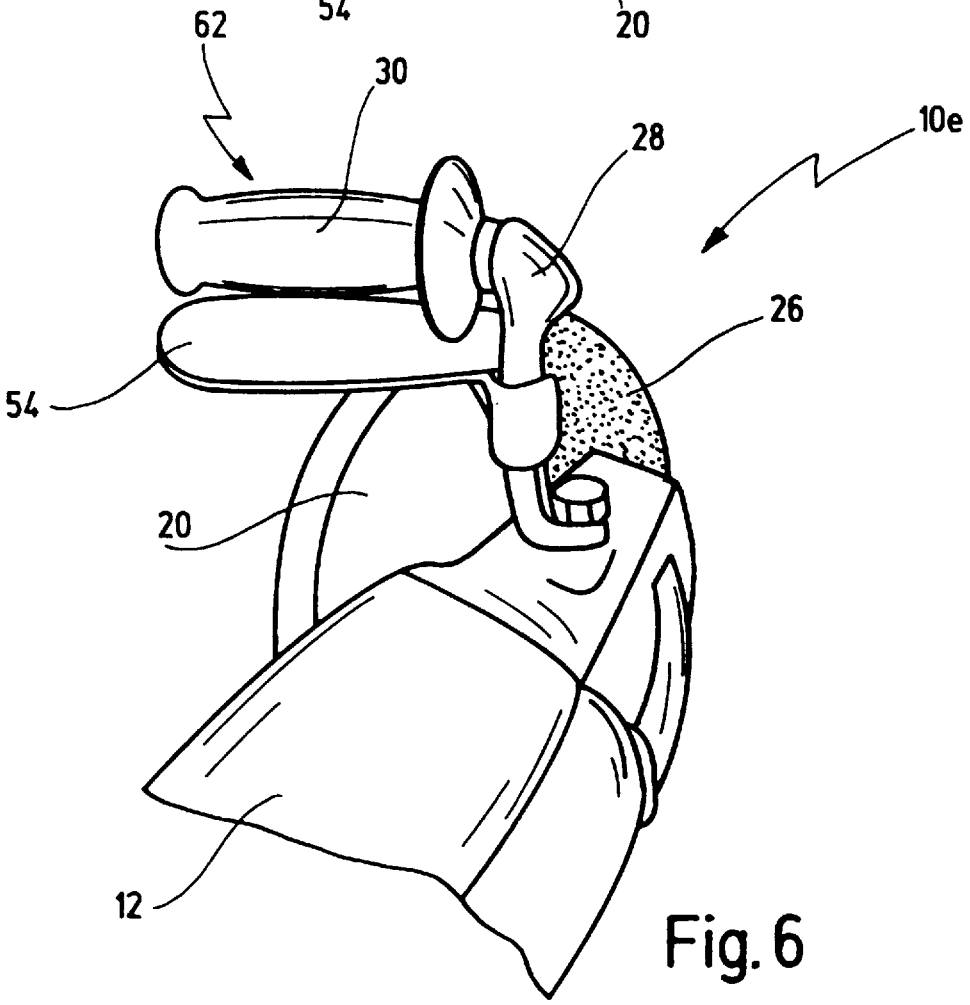
FIG. 6 shows a further modification of the embodiment shown in FIG. 4 in a position suitable for cutting, in a perspective representation, an additional safety shield once again being attached to the support.

FIG. 5 shows a hand tool, designated overall with the number 10*d*, which corresponds substantially to the embodiment shown in FIG. 3, and shows a right-angle grinder in a position suitable for roughing. Once again, a safety shield 54 is provided on support 28, although here, in contrast to the embodiment shorn in FIG. 3, support 28 itself is not widened between its two ends, but rather an additional safety shield 54 is attached to support 28 by means of eyes or the like.

FIG. 6 once again depicts a hand tool 10*e* in the form of a right-angle grinder in a position suitable for cutting, but here, in addition, there is additionally attached to support 28 a safety shield 54 which does not run parallel to the support itself, but rather runs, at a distance from first handle 30 in its second position 62 suitable for cutting, approximately parallel to handle 30.

Figure 7:
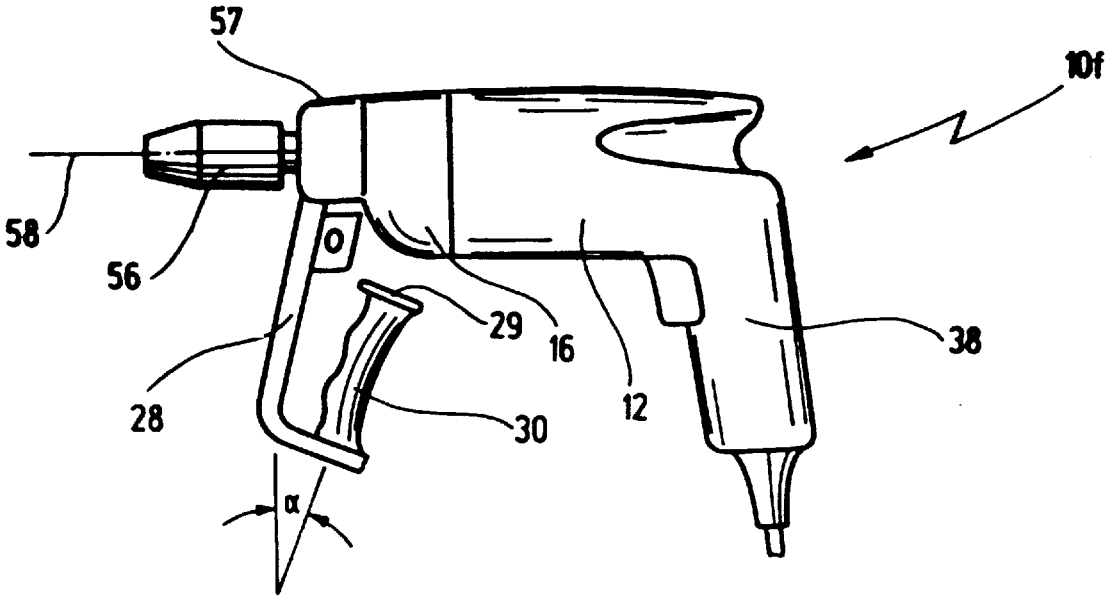
FIG. 7 shows a view of a further hand tool according to the invention, embodied as a power drill.

FIG. 7 depicts a hand tool 10*f* that is embodied as a power drill, screwdriver, or the like. Hand tool 10*f* has a drill chuck 56 and a pistol-shaped second handle 38 which is angled downward with respect to the remaining portion of housing 12.

Support 28 for first handle 30 is attached to spindle neck 57 of housing 12 with the aid of a band clamp or the like. Support 28 is configured as an approximately L-shaped bracket whose long limb is inclined slightly obliquely upward so that first handle 30 projects from the short limb of support 28, obliquely upward toward housing 12, inclined at an angle $\alpha$ of approximately 10 to 20°, free end 29 being located just below in the region of drive train housing 16.

This arrangement of first handle 30 in conjunction with second pistol-shaped handle 38 allows an ergonomically particularly good posture when using the power drill, which is advantageous particular for use as a hammer drill, but also for screwdriver use.

Because first handle 30 is fastened only at one end, and projects with its free end 29 toward drive train housing 16, a particularly good damping effect is guaranteed.

Figure 8:
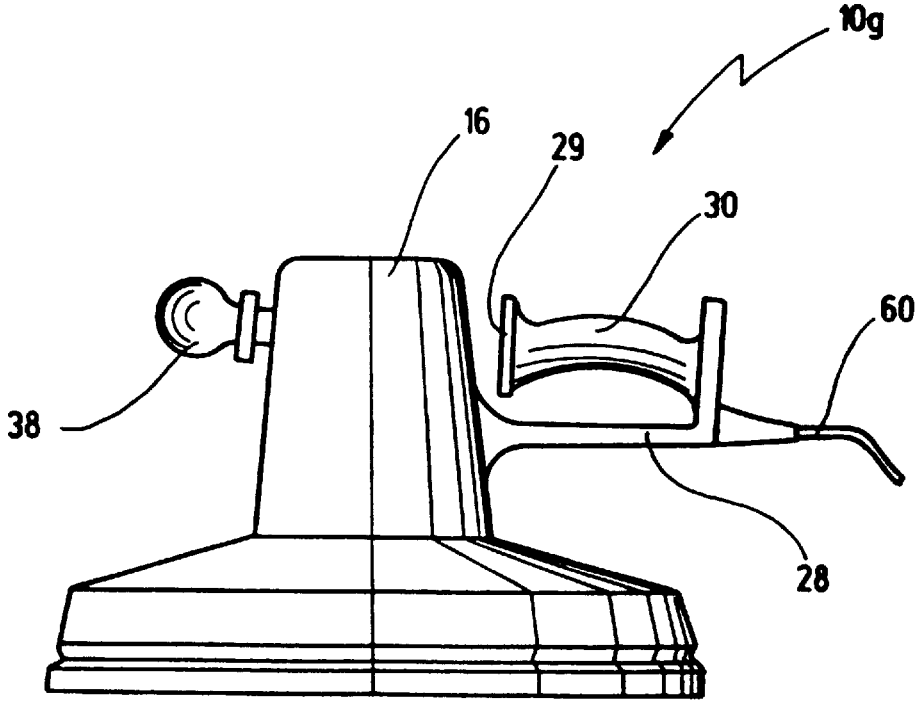
FIG. 8 shows a view of a further hand tool according to the invention that is configured as an orbital sander.

FIG. 8 shows a further embodiment of a hand tool according to the invention, designated overall with the number 10*g*.

Hand tool 10*g* is embodied here as an orbital sander, support 28, on which first handle 30 is fastened, projecting laterally out from drive train housing 16 which is of approximately truncated conical shape, and extending once again with its free end 29 toward drive train housing 16.

Second handle 38, which in this case is configured simply as a knob handle, is fastened on the opposite side of drive train housing 16.

Connecting cord 60 is advantageously guided integrally on support 28, so that it is guided laterally out and away without causing any impediment.

What is claimed is:

1. A right-angle grinder comprising:

an elongated housing having a longitudinal axis and comprising a drive train housing at a tool end thereof;

a drive received in said housing;

a drive spindle arranged within said drive train housing at an angle with respect to said longitudinal axis for driving a disk-shaped tool about a rotation axis;

a support having a first end and a second end, said first end being attached to said housing and said second end protruding laterally from said housing;

a first handle comprising an attachment end and a free end;

a first receptacle provided on said second end of said support for receiving said attachment end of said first handle in a first position such that said free end of said first handle projects in the direction of the housing, said first receptacle being arranged such that the first handle is arranged for roughing when in the first position;

a second receptacle provided on said second end of said support for receiving said attachment end of said first handle in a second position, said second receptacle being angled with respect to said first receptacle such that the first handle is arranged for cutting when in the second position; and a second handle formed on said housing on an end thereof facing away from the drive spindle wherein the right-angle grinder has a center-of-gravity defined by the distribution of its mass with respect to its longitudinal axis;

the first and second receptacles being arranged such that the first handle point towards the longitudinal axis of the housing when in the first position and such that the first handle extends above the disk-shaped tool and closely above the center-of-gravity, when in the second position.

2. The hand tool as defined in claim 1, wherein said support further comprises a second receptacle adapted for attaching the first handle in a second position that is angled with respect to the first position.

3. The hand tool as defined in claim 1, wherein the second receptacle is arranged such that the first handle, when attached in the second position, extends in such a way that a plane passing through the center of gravity of the hand tool extends approximately through the center of the first handle.

4. The hand tool as defined in claim 1, wherein the first receptacle is arranged so that in the first position, the first handle extends on a side of the drive train housing facing away from the tool in the vicinity of the rotation axis of the drive spindle.

5. The hand tool as defined in claim 1, further comprising a second handle which is arranged on an end of the housing facing away from the tool, substantially in the longitudinal direction of the housing, said second handle having a longitudinal axis and being displaceable about its longitudinal axis at least into two angular positions.

6. The hand tool as defined in claim 1, further comprising locking means for locking said support with its first end on the housing in various angular positions.

7. The hand tool as defined in claim 6, wherein said locking means comprise snap-lock elements provided on the housing and at the first end of the support and coacting with one another are for positive fastening of the support in various angular positions.

8. The hand tool as defined in claim 7, which further comprises a stop for limiting the angular position of the support.

9. The hand tool as defined in claim 1, wherein said support is configured as a damping element for damping vibrations.

10. The hand tool as defined in claim 1, wherein the support further comprises a surface configured as a safety shield.

11. The hand tool as defined in one of the foregoing claims, wherein said housing further comprises attachment points provided on two opposite sides of said housing for receiving said support.

12. The hand tool as defined in claim 5, said hand tool being configured as a power drill comprising a second pistol-shaped handle provided at an end of said housing facing away from the tool and further comprising a drill chuck for driving the tool about a rotation axis; wherein said first handle, when in its first position, is inclined obliquely to the rear toward said second pistol-shaped handle, at an acute angle with respect to a plane extending perpendicular to the rotation axis of said drill chuck.

* * * * *